US010288262B2

(12) United States Patent
Yuan et al.

(10) Patent No.: US 10,288,262 B2
(45) Date of Patent: May 14, 2019

(54) SOLID STATE LIGHTING DEVICE WITH AN ADJUSTABLE REFLECTOR

(71) Applicant: SIGNIFY HOLDING B.V., Eindhoven (NL)

(72) Inventors: Mou Kun Yuan, Eindhoven (NL); Liang Zhou, Eindhoven (NL); Ting Wen, Eindhoven (NL); Zhong Wang, Eindhoven (NL); Ken Xia, Eindhoven (NL); Jason Yang, Eindhoven (NL); Liu Forest, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/577,780

(22) PCT Filed: May 19, 2016

(86) PCT No.: PCT/EP2016/061322
§ 371 (c)(1),
(2) Date: Nov. 29, 2017

(87) PCT Pub. No.: WO2016/193016
PCT Pub. Date: Dec. 8, 2016

(65) Prior Publication Data

US 2018/0128453 A1 May 10, 2018

(30) Foreign Application Priority Data

Jun. 1, 2015 (WO) ..... PCT/CN2015/080501
Aug. 4, 2015 (EP) ..... 15179704

(51) Int. Cl.
*F21V 14/04* (2006.01)
*F21K 9/23* (2016.01)
(Continued)

(52) U.S. Cl.
CPC ..... *F21V 14/04* (2013.01); *F21K 9/23* (2016.08); *F21K 9/235* (2016.08); *F21K 9/237* (2016.08);
(Continued)

(58) Field of Classification Search
CPC ... F21V 14/04; F21V 7/16; F21K 9/23; F21K 9/235; F21K 9/237; F21K 9/65; F21Y 2103/10; F21Y 2115/10; F21Y 2101/00
(Continued)

(56) References Cited

U.S. PATENT DOCUMENTS 7,473,007 B1 1/2009 Wang
8,491,165 B2 7/2013 Bretschneider et al.
(Continued)

FOREIGN PATENT DOCUMENTS

DE 102012205465 A1 10/2013
FR 2864203 A1 6/2005
(Continued)

*Primary Examiner* — Anh T Mai
*Assistant Examiner* — Hana S Featherly

(57) ABSTRACT

The invention provides a solid state lighting device having an adjustable light output direction. In embodiments, an adjustable reflector element is provided, which is transitionable between at least a first and second orientation status, in order thereby to alter through which one or more of the light exit surfaces of the device the generated luminous output is directed.

8 Claims, 6 Drawing Sheets

(51) Int. Cl.

| | |
|---|---|
| ***F21K 9/235*** | (2016.01) |
| ***F21K 9/237*** | (2016.01) |
| ***F21V 7/16*** | (2006.01) |
| ***F21K 9/65*** | (2016.01) |
| *F21Y 101/00* | (2016.01) |
| *F21Y 103/10* | (2016.01) |
| *F21Y 115/10* | (2016.01) |

(52) U.S. Cl.
CPC ..... *F21K 9/65* (2016.08); *F21V 7/16* (2013.01); *F21Y 2101/00* (2013.01); *F21Y 2103/10* (2016.08); *F21Y 2115/10* (2016.08)

(58) Field of Classification Search
USPC ..... 362/277
See application file for complete search history.

(56) References Cited

U.S. PATENT DOCUMENTS

| | | | | |
|---|---|---|---|---|
| 2008/0074279 | A1 | 3/2008 | Chiu et al. | |
| 2009/0273948 | A1* | 11/2009 | Bryan ..... | G02B 6/0028 362/612 |
| 2012/0026732 | A1 | 2/2012 | Fricke | |
| 2012/0313500 | A1 | 12/2012 | Breidenassel et al. | |
| 2013/0170201 | A1 | 7/2013 | Chen | |
| 2014/0293603 | A1 | 10/2014 | Barnard et al. | |
| 2014/0347841 | A1 | 11/2014 | Hu et al. | |

FOREIGN PATENT DOCUMENTS

| | | | |
|---|---|---|---|
| WO | WO2010146518 | A1 | 12/2010 |
| WO | WO2013120892 | A2 | 8/2013 |

* cited by examiner

SOLID STATE LIGHTING DEVICE WITH AN ADJUSTABLE REFLECTOR

CROSS-REFERENCE TO PRIOR APPLICATIONS

This application is the U.S National Phase application under 35 U.S.C. § 371 of International Application No. PCT/EP2016/061322, filed on May. 19, 2016, which claims the benefit of European Patent Application No. 15179704.0, filed on Aug. 4, 2015, and Chinese Patent Application No. PCT/CN2015/080501, filed on Jun. 1, 2015. These applications are hereby incorporated by reference herein.

FIELD OF THE INVENTION

This invention relates to a solid state lighting device.

BACKGROUND OF THE INVENTION

Compact fluorescent lamps (CFLs) are a variety of fluorescent lamp, typically comprising fluorescent tubes which are bent or curved into a compact shape, to provide high luminous output with minimal form factor. They are designed in particular to provide high energy efficiency replacements to traditional incandescent light bulbs. An example of a standard prior art CFL lamp 10 is depicted in FIG. 1, for example.

Increasingly, however, solid state lighting is becoming a preferred option in both domestic and commercial applications, due to its extremely small form factor, long lifetime, high lumen efficiency, low operating voltage and fast modulation of lumen output. For this reason a number of LED replacement CFLs have been developed, comprising LED elements arranged to provide a luminous output having the same light distribution as CFLs and traditional incandescent bulbs.

However, provision of light over such a broad angular distribution (essentially) 360° requires a large number of LEDs, positioned in close proximity, to generate a large overall output flux. With such a high concentration of LED elements, efficient heat dissipation becomes problematic, leading to higher than optimal operating temperatures and a consequent deterioration in LED lifetimes. Moreover, the large number of LED components increases unit costs and seriously affects the energy efficiency of the lamps.

In response to these problems, a number of devices have been developed aimed at improving the light output efficiency and reducing the total number of required LED elements. FIGS. 2 and 3 show two examples of such proposed devices 12, as disclosed in US 2014/328065. Each comprises LED elements (not shown, but having position indicated by 18), arranged facing a light exit window 16, the window constraining the luminous output direction of the device 12 to just a limited range of output angles. In particular, both are adapted to produce a luminous output directed along, or arced around, just a single predominant axial direction (i.e. a luminous output having an angular width less than or equal to 180°). This means that energy is not wasted propagating light in directions in which it is not needed; luminous output may be concentrated across an area where it is most useful.

However, such directional devices carry clear disadvantages in terms of the scope of their applicability. Each is designed to connect into an existing light fitting, having most typically a fixed orientation. Hence, each of the bulbs of FIGS. 2 and 3, for example, can only ever be useful within a limited subset of lighting arrangements: those wherein the orientation of the fitting is such that the output window of the device, once the device is installed, is oriented facing in the intended output direction of the light fitting.

FIGS. 4-7 illustrate this difficulty. In FIGS. 4 and 5, the lamps of FIGS. 2 and 3 are respectively shown installed within a first example luminaire 22 having a first shape and orientation. As can be seen, only the lamp of FIG. 2 distributes light effectively from the luminaire, with the lamp of FIG. 3 directing much of its luminous output toward the walls of the luminaire, and not toward the lower output area. Similarly, FIGS. 6 and 7 show the lamps of FIGS. 3 and 2 installed respectively within a second example luminaire 24, having a second shape and orientation. In this case, it can be seen (FIG. 6) that only the lamp of FIG. 3 emits light in an effective manner from the luminaire, while in FIG. 7, almost all of the light of the lamp of FIG. 2 is directed toward a wall of the luminaire.

For directional lamps, therefore, the particular shape, style and light-output orientation of the lamp must be carefully chosen for each intended application. This confers numerous disadvantages for both distributers and retailers, but also users. In the case of retailers, a large number of different lamp varieties must be stocked at any one time, so that a buyer can be sure to find a lamp which is appropriate for their particular existing luminaire arrangement. This naturally increases stock costs, and overhead costs in terms of storage and display space. For end users too—particularly domestic users—the necessity of having to work out which of a large stock of lamps is in particular appropriate for their light fitting is extremely burdensome, and indeed risks frustration and significant inconvenience in the case that they choose an inappropriately shaped or oriented lamp in error. For example, it is very difficult to tell in advance, in which particular direction the light output window of the device of FIG. 2 will be facing once screwed or twisted into the electrical fitting of a luminaire.

Desired therefore is a LED lighting device, suitable for replacing existing compact fluorescent lamps, which offers improved luminous and thermal efficiency compared with pan-directional replacement devices, but which does not incur the above described disadvantages of limited range of applicability and the consequent costs therefore both in terms of money (to a retailer) and convenience (to an end user).

U.S. Pat. No. 7,473,007B1 discloses an adjustable lamp which includes a lamp and a scattering shade which is slidable on the lamp. The scattering shade has a front end coupled with a reflective blade which is bent at a selected angle to reflect light. By sliding the scattering shade on a light penetrative shade, the position of the reflective blade can be changed to alter the reflective direction of the light.

FR2864203A1 discloses a solar lighting device, which has LEDs producing directional lighting, and annular side wall producing diffused lighting, where reflecting surfaces are moved relative to LEDs between positions for obtaining diffused and directional lighting.

US2012/0026732A1 discloses a lamp which includes a bulb comprising at least a partially light-transmissive material, a lamp base for fitting the lamp in a socket and feeding electrical energy, an illuminant arranged in the bulb. The illuminant comprises a first light source and a reflector configured for directed emission of light output by the first light source, and the reflector is arranged rotatably about the light source, wherein the control lever is coupled to the reflector and the control lever can be displaced by a user to vary the emission direction of the light produced during operation of the lamp.

SUMMARY OF THE INVENTION

The invention is defined by the claims.

According to an aspect of the invention, there is provided a solid state lighting device comprising:

a housing having a first light exit surface and a second light exit surface;

at least one solid state lighting element contained in said housing for generating a luminous output;

an adjustable reflector contained in said housing having an adjustable orientation status for redirecting said luminous output to one of said first light exit surface and second light exit surface dependent on said orientation status; and a control member for adjusting the orientation status of the adjustable reflector;

wherein the adjustable reflector comprises a flexible planar element.

Embodiments of the invention thus provide a solid state lighting device having an adjustable light output direction. The arrangement of the adjustable reflector may be altered by means of the control member, which may comprise an externally accessible control element, to thereby switch through which one or more of the light exit surfaces the luminous output of the device is directed. The light exit surfaces may for example comprise differently oriented surfaces of the housing, for example surfaces having surface normals arranged pointing along differing directions. By moving the reflector between two or more different orientation states, light may be selectively directed toward different combinations of one or both of the exit surfaces, and hence the particular angles at which light is emitted from the device altered. This may allow the device to be employed within a wide variety of differently oriented and arranged light fittings, since the total luminous output generated by the LED elements may in each case be directed towards the particular light exit surface(s) whose orientation is most appropriate for the application in question. In this way the broad applicability of pan-directional devices is retained (since multiple different output angles are achievable) but while incorporating only the same number of LED elements as would be required for a uni-directional device—hence achieving the same improvements in luminous and thermal efficiency and in terms of unit costs.

Changing the orientation status of the reflector may comprise for example changing the position of the reflector within the housing, or changing the shape or arrangement of the reflector. The orientation states of the reflector may be such that there is at least one orientation status in which light is directed to only one of the two exit surfaces. For example, the reflector may be adapted to be switchable between a first orientation status in which light is directed toward a first exit surface, and a second orientation status in which light is directed toward a second exit surface. Or, in another example, the reflector may be adapted to be switchable between a first orientation status in which light is directed to both light exit surfaces, and a second orientation status in which light is directed to only one. These examples are cited for illustrative purposes only, and it will be understood that other particular permutations are also possible in different embodiments.

According to one set of examples, the solid state lighting elements may be arranged facing the first light exit surface, and the adjustable reflector having the adjustable position be adjustable between:

a first position in which the adjustable reflector does not interfere with the luminous distribution; and a second position in which the adjustable reflector redirects the luminous distribution towards the second light exit surface.

In the second position for example, the reflector may be arranged to be interposed between the lighting elements and the first light exit surface, and angled such that light incident upon it is redirected toward the second light exit surface. The reflector is effectively changed between an idle state—in which it plays no redirecting role—and an active state, in which it redirects all of, or at least a portion of, the luminous output in the direction of the second exit surface. In such an embodiment, misdirection of light to the wrong exit surface (and hence wastage of light) may be minimised, since in the first position, the natural orientation of the lighting elements guarantees that all or most light is directed toward the first surface, and in the second position, the reflector element itself blocks the light path in the direction of the first surface.

The housing may in some cases comprise at least one guide rail, wherein the adjustable reflector is mounted along said at least one guide rail. The guide rail(s) may provide an efficient, robust and reliable means for guiding or directing the change in orientation of the reflector from the first to the second position (and vice versa). The rail(s) may for example allow efficient and smooth 'transport' of the reflector between a first position within the housing and a second position within the housing. Alternatively, the guide rail(s) may for instance define a particular shape or arrangement transformation, for example guiding the reflector into a bent, curved or folded shape within the housing.

The guide rail(s) may for example each comprise a pair of parallel rail elements defining a channel for supporting and guiding an edge of the reflector element. Alternatively, each guide rail may comprise a single rail element for supporting and guiding the reflector element.

The housing may comprise a pair of curved guide rails.

The control member may according to any of these examples comprise a slider bar mounted on the adjustable reflector, said slider bar being externally accessible and facilitating the adjustment between the first position and the second position.

The curved guide rails may be arranged for example to guide at least a portion of a reflector into a second orientation state in which it is arranged at a curved incline, having a reflective surface disposed in the light path of the lighting elements, at an angle such that light is redirected towards the second light exit surface. The reflector element may for example be a flexible planar element, and the transition between the first and second position comprise a transition between an essentially flat shape of the reflector and a curved or bent shape of the reflector. The guide rails may guide the reflector from a first lateral position within the reflector to a second lateral position within the reflector, for example from a position substantially at a first end of the reflector to a position substantially at a second end of the reflector.

The lighting device may further comprise a heat sink between the housing and a connection cap of the solid state lighting device, said heat sink comprising at least one further guide rail extending along a direction from the connection cap to the housing, wherein the slider bar comprises an exposed portion mounted in the at least one further guide rail to facilitate said adjustment between the first position and the second position.

The further guide rail may for example be arranged to guide the reflector between a position in the housing substantially adjacent to the connection cap and a second position in the housing substantially adjacent to one or both of the light exit surfaces. The slider bar provides a convenient means of manipulating the position of the reflector along the guide rail and the co-operating further guide rail. The slider bar may comprise a solid bar coupled or fixed across its length to one end of the reflector element, and have an exposed control element protruding from the heat sink or housing to allow manipulation of the bar by a user.

The first light exit surface may adjoin the second light exit surface under a non-zero angle such as a perpendicular angle. The two light exit surfaces in this case may define different 'sides' or side surfaces of the housing, such that manipulation of the reflector element allows control over which side of the device light is output from. The difficulties illustrated by FIGS. 4-7 may hence be avoided, using this embodiment, since the directional output of the device may be switched to accord with the particular intended application.

According to a second set of example embodiments, the at least one solid state lighting element comprises a plurality of solid state lighting elements which may be arranged in respective first and second rows on opposing surfaces of the housing, wherein the adjustable reflector having the adjustable shape is adjustable between:

a first shape in which the luminous output of the first row of solid state lighting elements is reflected towards the first light exit surface and the luminous output of the second row of solid state lighting elements is reflected towards the second light exit surface opposing the first light exit surface; and a second shape in which the respective luminous outputs of the first and second rows of solid state lighting elements are reflected towards the first light exit surface.

The first and second light output surfaces are hence in this case arranged facing opposite to one another, and the solid state lighting elements arranged along two parallel, opposing rows in between the two exit surfaces. The two shapes of the reflector element allow transition between a state in which light is directed from the lighting elements toward just one of the two exit surfaces and a second state in which light is directed toward both light exit surfaces. This allows the option, once the device is installed, to switch between a multi-directional output mode and a uni-directional output mode.

The adjustable reflector may according to this set of examples be mounted on a central axle extending through said housing, said central axle comprising the control member for rotating said central axle to adjust the reflector between the first shape and the second shape.

For example, the first shape may be a planar shape in which a first surface of the adjustable reflector faces the first row of solid state lighting elements and a second surface of the adjustable reflector opposite said first surface faces the second row of solid state lighting elements;

the second shape may be a folded shape in which a first section of the first surface faces the first row of solid state lighting elements and a second section of the first surface faces the second row of solid state lighting elements; and a portion of the adjustable reflector comprising the second section may be deformable.

The reflector may for example comprise first and second portions, joined rotatably at the axle, such that at least the second portion is pivotable about the axle between a first angular position and a second angular position. By adjusting said angular position, its upper and lower opposing surfaces (comprising respectively the second section of the first surface and the second section of the second surface) may respectively be brought into or out of incidence with light generated by the second row of lighting elements. In this way, light form the second row may either be directed toward the first exit surface or the second exit surface. By rotating the axle (by means of the control element), the second portion of the reflector may be pivoted between its two or more rotational positions.

In examples, an edge portion of the second section may comprise a plurality of cut-outs for allowing the second section to pass the second row of solid state lighting elements.

The adjustable reflector may be a reflector film.

The device may be a light bulb such as a replacement for a CFL light bulb.

In addition, according to a further aspect of the invention, there is provided a luminaire comprising one or more of the example solid state lighting device embodiments described above.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
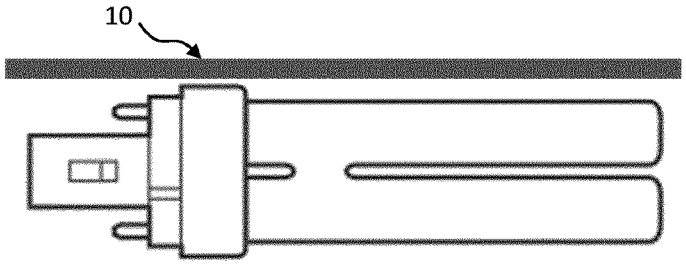
FIG. 1 (PRIOR ART)
FIG. 1 depicts an example compact fluorescent lamp (CFL) as known in the art.
Figure 2:
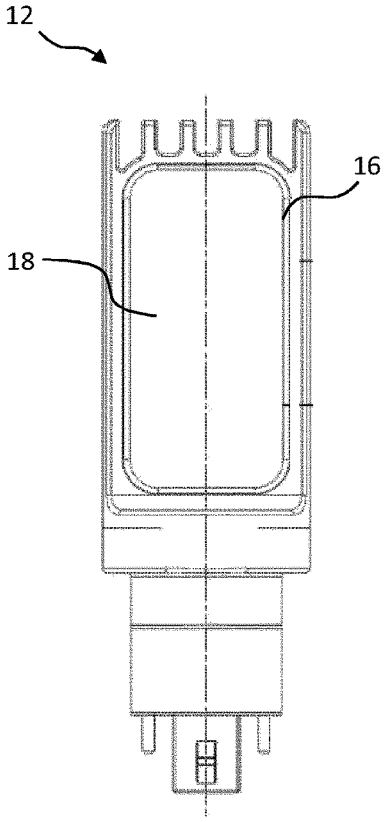
FIG. 2 (PRIOR ART)
FIG. 2 depicts an example from the prior art of a solid state replacement for a compact fluorescent lamp.
Figure 3:
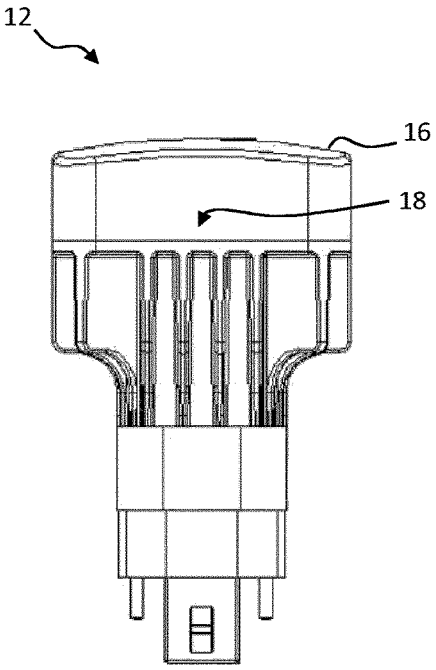
FIG. 3 (PRIOR ART)
FIG. 3 depicts a second example from the prior art of a solid state replacement for a compact fluorescent lamp.

The invention provides a solid state lighting device having an adjustable light output direction. In embodiments, an adjustable reflector element is provided, which is transitionable between at least a first and second orientation status, in order thereby to alter through which one or more of the light exit surfaces of the device the generated luminous output is directed.

Embodiments allow for flexibility in the applications of the device, since the output profile of the device may be adapted to fit with the particular structural or functional arrangements of the luminaire in which it is installed, for example. In this way the total luminous output of embodiments may be fully employed to illuminate only along those directions where light is most usefully directed.

It should be understood that the Figures are merely schematic and are not drawn to scale. It should also be understood that the same reference numerals are used throughout the Figures to indicate the same or similar parts.

Figure 8:
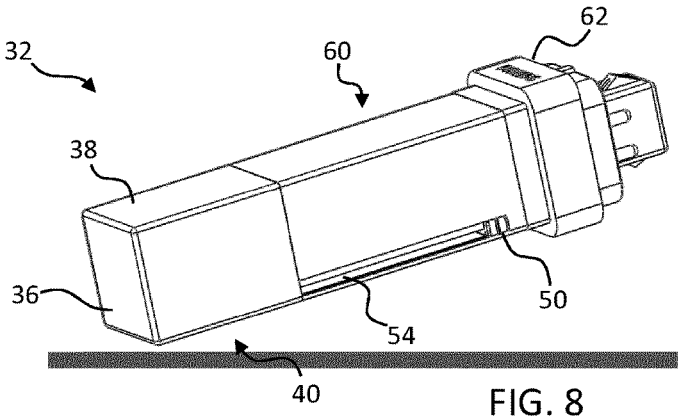
FIG. 8 depicts in perspective view a first example solid state lighting device.
Figure 9:
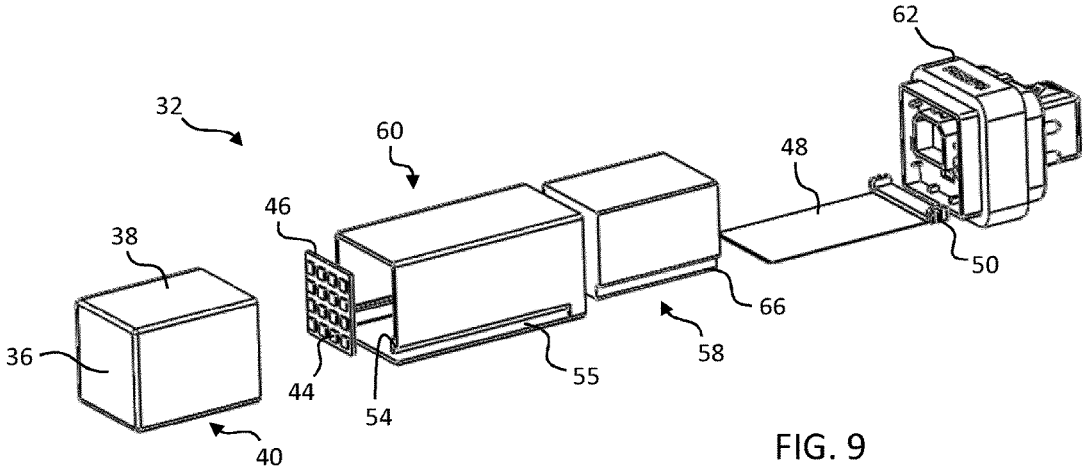
FIG. 9 depicts an exploded view of the first example solid state lighting device.

In FIGS. 8 and 9 are depicted perspective and blow-up views respectively of a first example lighting device 32 in accordance with embodiments of the invention. The device comprises an outer housing structure, formed of two main housing portions: a light output portion 40 and a body portion 60. The housing forms an elongate cuboid structure, extending from a connection cap 62 mounted at one end. The light output portion 40 of the housing comprises first 36 and second 38 light exit surfaces, which respectively comprise a 'bottom' or 'end' surface and a 'side' surface of the light exit structure. In some examples, the light exit surfaces may comprise light exit windows or areas formed in or through larger surrounding surfaces.

Disposed within the housing is a plurality of LED elements 44, arranged, in the particular example of FIGS. 8 and 9, in an array formation upon a supporting PCB 46. The PCB 46 is oriented such that light exit surfaces of the LED elements are arranged facing in the direction of the first light exit surface 36 of the light exit portion 40 of the housing. The PCB carrying the array of LED elements may, for example, be mounted at or around the junction between the body portion 60 and the light exit portion 40 of the housing structure, having its major surface facing toward the first light exit surface 36.

Arranged between the LED elements 44 and the connection cap 62 is a heat sink structure 58 for assisting in dissipating heat away from the LED elements. The heat sink may, for example, comprise a truncated cuboid structure, of outer dimensions narrower than those of the either the body portion 60 or the light exit portion 40 of the housing structure. The heat sink may in this case for example be arranged or mounted within the outer shell of the body portion of the housing, in thermal communication with the array of LED elements. Note that in alternative examples, the heat sink may assume any number of forms and arrangements within the device (or may be exposed from the housing to ambient air), for example comprising a different shape, a different structure or a different relative position within the overall housing structure.

Running along the interior of opposing side walls of the body portion 60 of the housing structure, adjacent to the bottom surface of the body portion, are opposing guide rails 54 for supporting and guiding the movement of an adjustable reflector element 48 within the housing. The adjustable reflector comprises a major planar portion having a reflective upper surface, with a slider bar 50 mounted across one end for effecting the transport of the reflector along the guide rails. The slider bar comprises protruding handle members at either end for manipulating the slider bar from outside of the housing structure. The handle members extend through two continuous narrow openings 55 formed through the bottom-most portions of the body 60 side walls, directly adjacent and parallel with each of the guide rails.

The slider bar may in some examples, for instance, be itself mounted within the guide rails, and the major planar portion of the reflector merely supported by the rails, resting either above or below them. Alternatively, the planar portion of the reflector may be mounted within the guide rails while the slider bar rests beneath or atop them.

The guide rails may, according to examples, comprise guide channels, each formed by two parallel, opposing rail elements which co-operate to form a narrow conduit along which one or both parts of the reflector element (the slider bar 50 and planar portion) are arranged to slide. The height of said channels may be formed such that the channel partially 'grips' the two side edges of the planar portion of the reflector 48. Alternatively, the height of the channels may be formed such that there is little or no resistance to the sliding of the reflector along the channels, and the channels merely acts to 'contain' or hold the reflector at a particular vertical position within to the housing, i.e. to support the reflector vertically, and to prevent slipping or transit of the reflector into an upper portion of the housing.

When the device is in its final constructed state (as illustrated by FIG. 8), the body portion 60 of the housing is connected directly to connection cap 62 (or connected via heat sink 58), and the reflector 48 is positioned within said body portion, resting upon its bottom surface, or supported parallel to the bottom surface within or on the guide rails 54. The reflector is positioned such that the end handle elements of the slider bar 50 are disposed protruding through openings 55. By sliding the slider bar—by means of the protruding handle elements—from a first position, adjacent to the connection cap 62, to a second position, adjacent to the light exit portion 40 of the housing structure, the reflector may correspondingly be slid between an initial state in which it is positioned wholly or substantially within the body portion of the housing, and a final state, in which at least a portion of the reflector is disposed within the light exit portion 40 of the housing.

Figure 10:
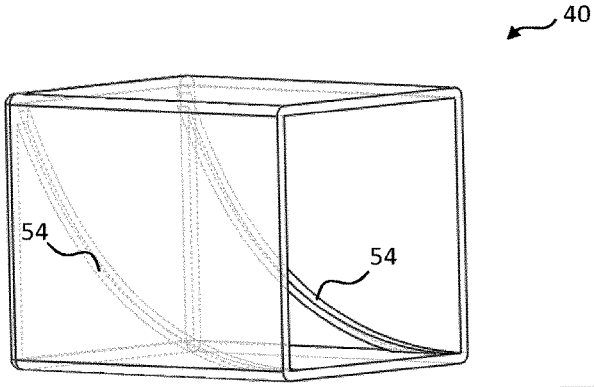
FIGS. 10 and 11 depict perspective views of a portion of the interior of the first example solid state lighting device.
Figure 11:
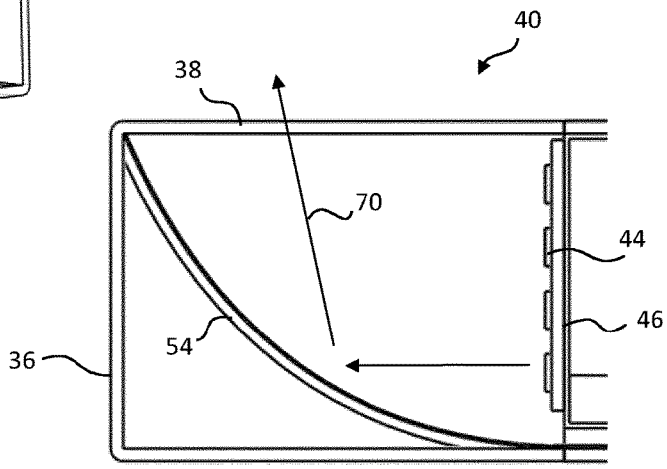

FIGS. 10 and 11 depict the interior of the light exit portion 40 of the housing structure, wherein the guide rails 54, continue from their path through the body portion, but curve upwards on entering the light exit portion 40, extending from the base of the housing to the top of the housing, as they span the light exit portion 10, effectively defining a curved diagonal partition across it.

As the reflector 48 is slid along the guide rails, from its initial position, substantially within the body 60 of the housing, to its second position, partially within the light exit portion 40 of the housing, the curved portion of the guide rails induces the reflector to bend in congruence with the curvature of the rails. Once the reflector has been fully slid along the rails—such that one end is disposed adjacent to first light exit surface 36—the portion of the reflector supported by the curved guide rails is bent so as to define a curved plane which forms a partition between the solid state lighting elements 44 and the first light exit window 36. Moreover, as illustrated in FIG. 11, the curvature defined by the curved rails 54 is such that light 70 incident upon the reflector 48, when in this curved/engaged state, is redirected by the upper (reflective) surface of the reflector in the direction of the second light exit surface 38.

Hence, by sliding the slider bar 50 between its first position, adjacent to the connection cap 62, and its second position, adjacent to the light exit portion 40 of the housing, the reflector 48 is moved between an initial 'idle' position, in which it is 'hidden' from the light paths of the LED elements, to a second 'engaged' position, it which it is interposed, at a curved incline, between the LED elements 44 and the first light exit window 38. When the reflector is in its first (idle) position, light is emitted from the housing predominantly or entirely through the first light exit surface 36. When the reflector is in its second (engaged) state, light is emitted from the housing predominantly or entirely through the second light exit surface.

Note that according to some examples, the heat sink element 58 may comprise further guide rails 66 for guiding or supporting the transport of the reflector element 48 between the connection cap 62 and the body portion of the housing. For example, the further guide rails may have the same shape and construction as the guide rails 54 of the body portion, and be arranged or positioned along side-walls of the heat sink so as to align and co-operate with the guide rails of the body housing portion 60. In alternative examples, however, such as in cases where the heat sink is mounted or disposed within the body portion 60 of the housing itself (in thermal communication with the LED elements), the heat sink may comprise cut-outs or notches formed along either side of its bottom-most surface, shaped and aligned to co-operate with the guide rails 54 of the housing. In this way, the heat sink may fit within the outer shell of the housing, without snagging or interfering with the guide rails 54 or the sliding operation of the reflector element 48.

Figure 4:
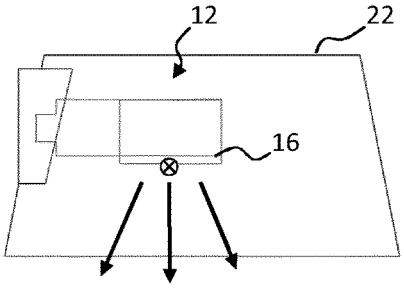
FIG. 4 (PRIOR ART)
FIGS. 4-7 illustrate the functional deficiencies of prior art solid state replacement compact fluorescent lamps.
Figure 5:
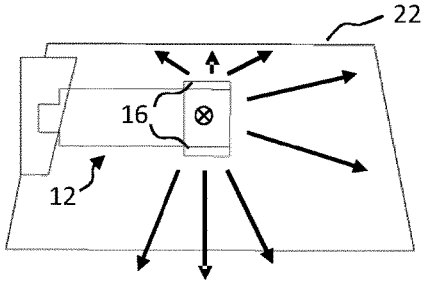
FIG. 5 (PRIOR ART)
Figure 6:
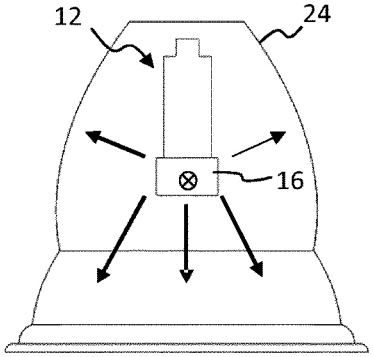
FIG. 6 (PRIOR ART)
Figure 7:
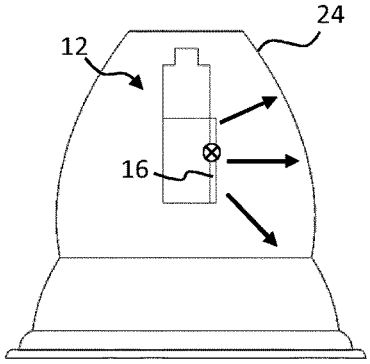
FIG. 7 (PRIOR ART)

Referring again to FIGS. 4-7, embodiments of the invention, in accordance with the examples of FIGS. 8-11, resolve the difficulty of compatibility with differently oriented or arranged luminaires, since the light output direction may be switched to match the intended application. For example, in the case that the lamp 32 is to be installed within a vertically oriented luminaire, such as those depicted in FIGS. 6 and 7, the slider may be manipulated into its first position, adjacent to the connection cap, such that the reflector is held withdrawn from the light output portion of the housing, in its 'idle'/flat state. In this way, light from the LED elements is directed substantially through the 'end' of the device (i.e. through the first light exit surface 36). Alternatively, in the case that the lamp 32 is to be installed within a horizontally oriented luminaire, such as those depicted in FIGS. 4 and 5, the slider may be manipulated into its second position, adjacent to the light exit portion 40, such that the reflector is slid into its curved/engaged state within the light exit portion of the housing. In this state, the reflector is arranged such that light is blocked from passing through the first light exit surface, and is redirected toward the second light surface. Hence light in this case is output through a 'side' surface of the device, and not an 'end' surface, rendering it suitable for use in the horizontal type luminaire of FIGS. 6 and 7.

By way of non-limiting example, the planar portion of the reflector element may comprise a reflector film, for example a layer of reflector film formed over the major surface(s) of a base layer of flexible material, or simply a layer of reflector film on its own.

The connector cap 62 may be a connector cap of any variety, suitable for making electrical and mechanical connection with an existing light fitting, for example, so as to render the lighting device 32 suitable for installation within an existing luminaire—for example as a replacement to an existing compact fluorescent lamp. The cap may, by way of example, comprise a screw cap fitting, a bayonet fitting, a GU-type fitting or a MR-type fitting. The cap may be made out of a suitable electrically conductive material, for example.

According to the above-described example, or any other examples or embodiments, the body portion 60 and/or light exit portion 40 of the housing structure may be made of plastics. In particular, it may be desirable that the light exit portion 40 of the housing comprise a diffused plastic cover, for example translucent or frosted plastic, to thereby provide output illumination of an even or homogeneous intensity. A diffused plastic cover may avoid problems of glare, or avoid the occurrence of so-called bright spots in the output distribution, wherein the luminous output comprises isolated points of high intensity surrounded by a broader area of much lower intensity. Additionally, diffused plastic may be preferred for other aesthetic reasons, for example to give to the housing of the lamp—when switched on—an even, homogenous appearance.

However, note that in alternative examples, the light exit portion of the housing may comprise a transparent outer material, for example a transparent plastic. This may be preferred, for example, in cases where output intensity is desired to be maximised, at the cost of homogeneity of output, or for example where the output is intended to be more narrowly focussed, for example by one or more beam shaping elements.

Figure 12:
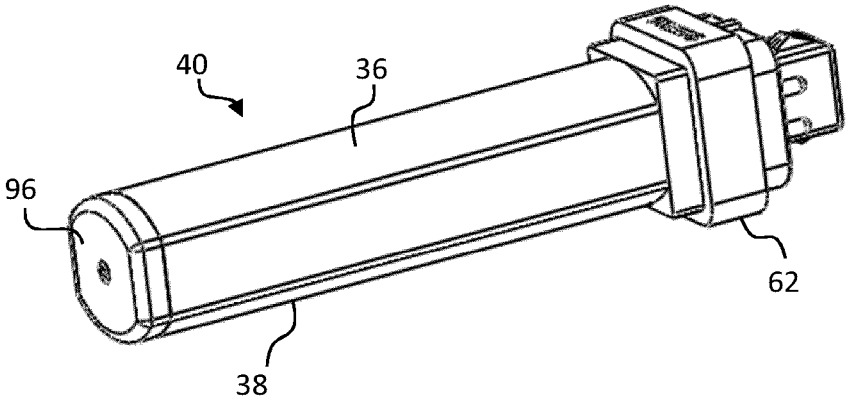
FIG. 12 depicts in perspective view a second example solid state lighting device.
Figure 13:
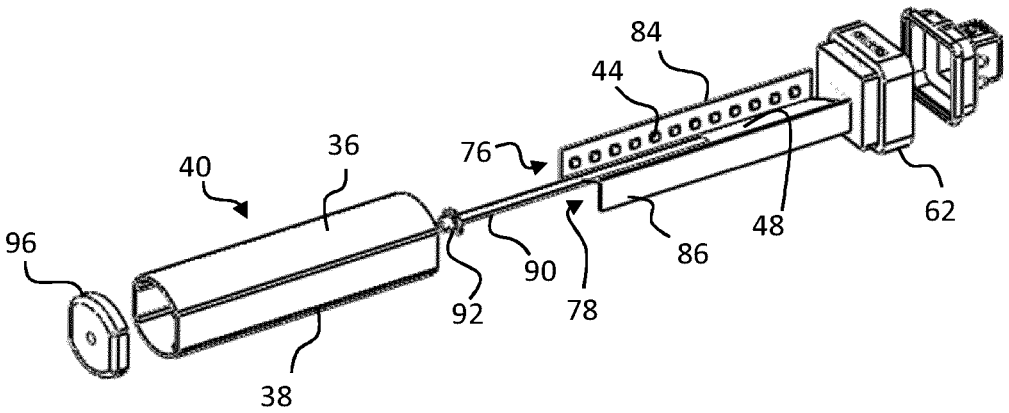
FIG. 13 depicts an exploded view of the second example solid state lighting device.

In FIGS. 12 and 13 are depicted perspective and exploded views respectively of a second example solid state lighting device in accordance with embodiments of the invention. As with the example of FIGS. 8-11, the device comprises an elongate outer housing structure, extending from a connection cap 62. As is clear from FIG. 13, in this example the housing structure comprises only a single section (light exit portion 40), within which are housed both the LED elements 44 and the adjustable reflector 48. For brevity, the light exit portion 40 of the housing shall for the purposes of description of the present embodiment be referred to simply as the housing 40.

The housing 40 comprises opposing first 36 and second 38 light exit surfaces, each forming a respective 'horizontal' 'or radial' surface of the housing structure. The LED elements are arranged along respective first 76 and second 78 rows, mounted on respective first 84 and second 86 PCBs, running along opposing surfaces of the housing 40. The LEDs of each row are oriented so as to emit light across the body of the housing in the direction of the opposing row. Positioned between the rows, mounted along its centre by a central axle 90, is the adjustable reflector 48, arranged in two planar sections, pivotable about the central axle in order to deform or fold the reflector into different arrangements or orientations.

Figure 14:
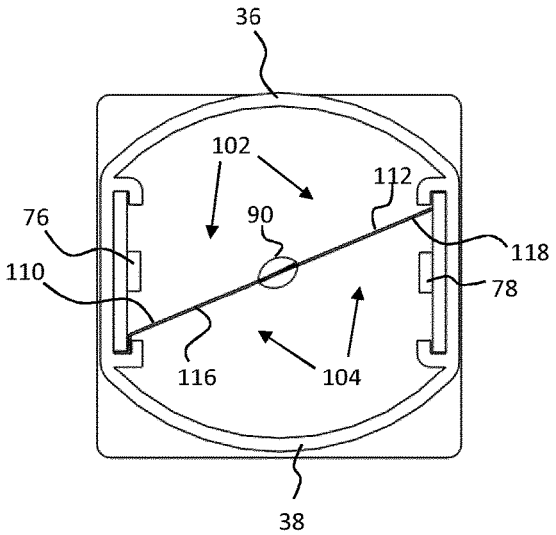
FIGS. 14 and 15 depict a first interior view of the second example solid state lighting device, corresponding to a first mode of operation.
Figure 15:
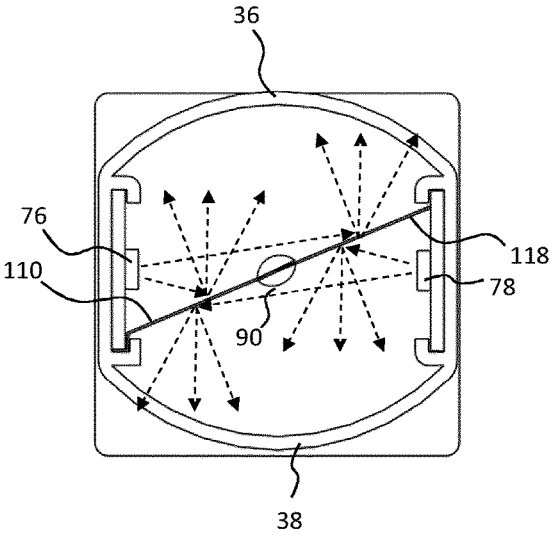
Figure 16:
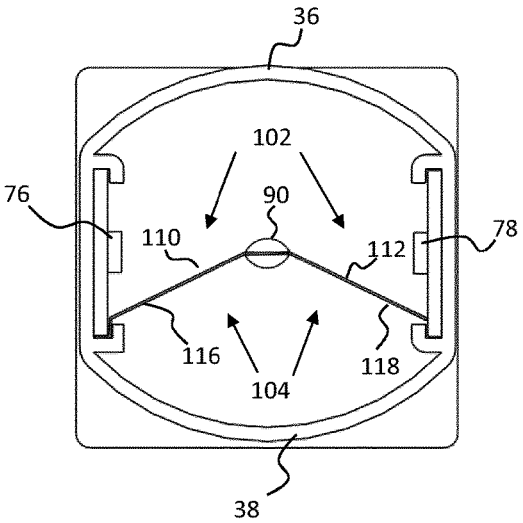
FIGS. 16 and 17 depict a second interior view of the second example solid state lighting device, corresponding to a second mode of operation.
Figure 17:
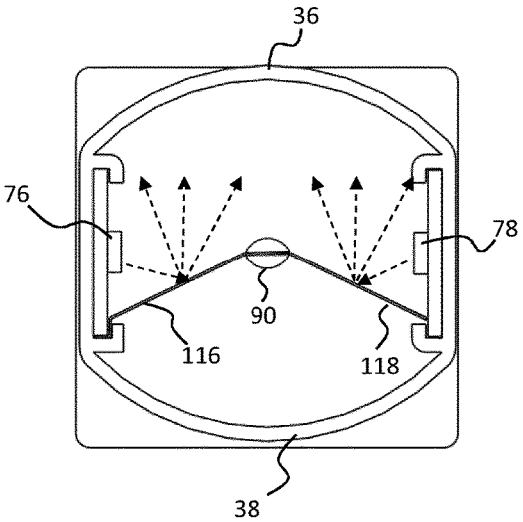

The structure of the reflector 48 within the housing 40 is depicted more clearly in FIGS. 14-17, which illustrate the two different orientations or shapes which the reflector may be manipulated, by means of rotation of the axle 90, to adopt. The axle divides the reflector into first and second portions (shown extending toward the left and right of the axle respectively in FIGS. 14-17), at least the second of which is rotatable or pivotable about the axle 90 between an 'upwards', inclined position (FIGS. 14 and 15) and a 'downwards', declined position (FIGS. 16 and 17). In various examples, the first (left) portion might also be pivotable in a similar manner.

The reflection comprises a first (upper) reflective surface 102 and a second (lower) reflective surface 104. The upper reflective surface 102 is divided by the axle into a first section 110 and a second section 112, and likewise the lower reflective surface 104 is divided into an a first section 116 and a second section 118. The axle hence effectively divides the reflector into left-hand and right-hand portions, each comprising upper (110 and 112 respectively) and lower (116 and 118) reflective surface sections.

The central axle may be twistable or rotatable within the structure by means of an external control element, said rotation acting to thereby deform or bend or pivot the second (right-hand) portion of the reflector from a flat shape (FIGS. 14 and 15), wherein it is oriented parallel with the left-hand portion, to a 'folded' or bent shape (FIGS. 16 and 17) wherein it is disposed at an angle to the left hand portion. As shown in FIG. 13, the axle 90 furthermore comprises a rotation locking member 92 which allows the orientation/shape of the reflector 48 to be fixed (temporarily) after rotation of the axle.

FIGS. 14 and 15 illustrate the first arrangement of the adjustable reflector 48, wherein the reflector is oriented at an angle between the two sides of the housing, extending form a point below the first row 76 of LEDs on the left side of the housing (as shown in FIGS. 14 and 15) to a point above the second row 78 of LEDs on the right hand side of the housing. In this arrangement, the upper surfaces 110, 112 of both the first and second portion of the housing are disposed within the light path of the first row of LED elements, and angled so as to redirect light incident from said first row in the direction of the first (upper) light exit surface 36 of the housing. At the same time within this arrangement, the lower reflective surfaces 116, 118 of both the first and second portions of the reflector are disposed within the light path of the second row 78 of LED elements, and angled such that light incident from said second row is redirected toward the second (lower) light exit surface 38 of the housing. Hence, when the reflector is oriented according to the arrangement of FIGS. 14 and 15, the total luminous output of the device is split between the first and second (upper and lower) light output surfaces. In this mode of operation, light is output though both of these horizontal surfaces, and hence the device may be used to direct light in both directions at once.

FIGS. 16 and 17 illustrate the second possible arrangement of the adjustable reflector 48 according to the example device depicted in FIGS. 12 and 13. In this arrangement, the reflector is bent into a 'downward' facing quasi V-shape, with the left-hand portion of the reflector extending from the axle 90 to a point below the first row 76 of LED elements (in common with the arrangement of FIGS. 14 and 15), and the right-hand portion extending from the axle 90 to a point below the second row 78 of LED elements. In this arrangement, the first section 110 of the upper surface 102 of the reflector 48 is disposed within the light path of the first row 76 of LEDs, and angled to redirect incident light in the direction of the first (upper) light exit window 36, and the second section 112 of the upper surface 102 of the reflector 48 is disposed within the light path of the second row 78 of LEDs, and also angled to redirect incident light in the direction of the first (upper) light exit surface 36. Hence, when the reflector is oriented according to the arrangement of FIGS. 16 and 17, the total luminous output of the device is directed toward only a single exit surface—namely, the first exit surface 36—and the device correspondingly outputs light only in this single direction.

The adjustable reflector of the example device of FIGS. 12 and 13 hence allows for the device to be switched between a uni-directional mode—in which light is output through only a single exit surface—and a bi-directional mode—in which light is output through two opposing exit surfaces. In the latter case, the device may be suitable for use in almost any luminaire—for example in both the vertical 24 and horizontal 22 luminaire varieties of FIGS. 4 and 6 respectively. However, by switching to the uni-directional (horizontal output) mode of operation, the lamp is rendered specially applicable for efficient use in horizontal-type luminaires, since light is concentrated through a single horizontal window, and distributed evenly across said window.

Figure 18:
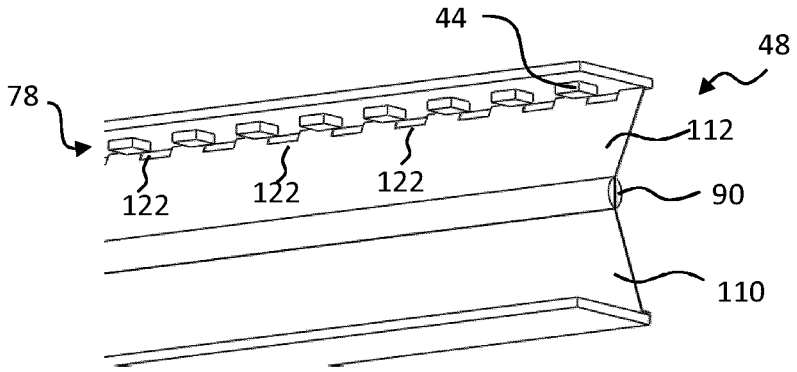
FIG. 18 depicts a third interior view of the second example solid state lighting device.

In FIG. 18 is depicted a second view of the reflector 48, from the 'top' (or first exit window 32) side of the device. More clearly visible are a plurality of notches or cut-outs formed along the edge of the second portion of the reflector, spaced and shaped so as to allow said portion to slide between angular positions above and below the second row 78 of LED elements without snagging the LED elements themselves. In alternate examples, in which it is desirable that the first portion of the reflector also pivot in a similar way, equivalent notches may additionally be provided along the edge of the first portion of the reflector.

According to this or any other embodiment of the invention, the PCB(s) carrying the plurality of solid state lighting elements 44 may be formed with use of high quality printing oil, in order to maximise the luminous output efficiency of the device.

The lighting device 32 according to one or more embodiments of the present invention may be advantageously included in a luminaire such as a holder of the lighting device, e.g. a ceiling light fitting, or an apparatus into which the lighting device is integrated, e.g. a cooker hood or the like. Other suitable types of luminaires, e.g. advertising luminaire comprising an array of tubular lighting devices and so on, will be apparent to the skilled person.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A solid state lighting device comprising:

a housing having a first light exit surface and a second light exit surface;

at least one solid state lighting element contained in said housing for generating a luminous output;

an adjustable reflector contained in said housing having an adjustable orientation status for redirecting said luminous output to one of said first light exit surface and second light exit surface dependent on said orientation status; and a control member for adjusting the orientation status of the adjustable reflector;

wherein the adjustable reflector comprises a flexible planar element, wherein the adjustable reflector having the adjustable orientation status has an adjustable shape;

wherein the at least one solid state lighting element comprises a plurality of solid state lighting elements which are arranged in respective first and second rows on opposing surfaces of the housing, and wherein the adjustable reflector having the adjustable shape is adjustable between:

a first shape in which the luminous output of the first row of solid state lighting elements is reflected towards the first light exit surface and the luminous output of the second row of solid state lighting elements is reflected towards the second light exit surface opposing the first light exit surface; and a second shape in which the respective luminous outputs of the first and second rows of solid state lighting elements are reflected towards the first light exit surface.

2. The solid state lighting device of claim 1, wherein the adjustable reflector is mounted on a central axle extending through said housing, said central axle comprising the control member for rotating said central axle to adjust the reflector between the first shape and the second shape.

3. The solid state lighting device of claim 2, wherein:

the first shape is a planar shape in which a first surface of the adjustable reflector faces the first row of solid state lighting elements and a second surface of the adjustable reflector opposite said first surface faces the second row of solid state lighting elements;

the second shape is a folded shape in which a first section of the first surface faces the first row of solid state lighting elements and a second section of the first surface faces the second row of solid state lighting elements; and wherein a portion of the adjustable reflector comprising the second section is deformable.

4. The solid state lighting device of claim 3, wherein an edge portion of the second section comprises a plurality of cut-outs for allowing the second section to pass the second row of solid state lighting elements.

5. The solid state lighting device of claim 1, wherein the adjustable reflector is a reflector film.

6. The solid state lighting device of claim 1, wherein the device is a light bulb such as a replacement for a CFL light bulb.

7. A luminaire comprising the solid state lighting device of claim 1.

8. A solid state lighting device comprising:

a housing having a first light exit surface and a second light exit surface;

at least one solid state lighting element contained in said housing for generating a luminous output;

an adjustable reflector contained in said housing having an adjustable orientation status for redirecting said luminous output to one of said first light exit surface and second light exit surface dependent on said orientation status; and a control member for adjusting the orientation status of the adjustable reflector;

wherein the adjustable reflector comprises a flexible planar element, wherein the adjustable reflector having the adjustable orientation status has an adjustable position;

wherein the at least one solid state lighting element comprises a plurality of solid state lighting elements which are arranged in respective first and second rows on opposing surfaces of the housing, and wherein the adjustable reflector having the adjustable shape is adjustable between:

a first shape in which the luminous output of the first row of solid state lighting elements is reflected towards the first light exit surface and the luminous output of the second row of solid state lighting elements is reflected towards the second light exit surface opposing the first light exit surface; and a second shape in which the respective luminous outputs of the first and second rows of solid state lighting elements are reflected towards the first light exit surface.

* * * * *